US007398901B2

(12) United States Patent
Vouriot

(10) Patent No.: US 7,398,901 B2
(45) Date of Patent: Jul. 15, 2008

(54) DEVICE ENABLING A FOOTWARE ITEM TO BE REMOVED FROM A MOULD

(76) Inventor: Michel Vouriot, 2, rue Truaude, Sainte Savine (FR) 10300

( * ) Notice: Subject to any disclaimer, the term of this patent is extended or adjusted under 35 U.S.C. 154(b) by 730 days.

(21) Appl. No.: 10/503,512

(22) PCT Filed: Feb. 11, 2002

(86) PCT No.: PCT/FR02/00507

§ 371 (c)(1),
(2), (4) Date: Aug. 4, 2004

(87) PCT Pub. No.: WO03/069040

PCT Pub. Date: Aug. 21, 2003

(65) Prior Publication Data

US 2005/0173476 A1 Aug. 11, 2005

(51) Int. Cl.
*D06C 5/00* (2006.01)

(52) U.S. Cl. ..... 223/75; 223/111

(58) Field of Classification Search ..... 223/112, 223/111, 120, 60, 75, 76, 77; 112/121.5
See application file for complete search history.

(56) References Cited

U.S. PATENT DOCUMENTS 3,206,023 A * 9/1965 Kronsbein ..... 209/545
3,790,047 A * 2/1974 Laxson ..... 223/112
5,467,905 A * 11/1995 Cortese ..... 223/112
5,941,431 A * 8/1999 Parker ..... 223/112
6,886,723 B2 * 5/2005 Manini ..... 223/75
2005/0173476 A1 * 8/2005 Vouriot ..... 223/112

FOREIGN PATENT DOCUMENTS

EP 0534157 A 3/1993

* cited by examiner

*Primary Examiner*—Gary L. Welch
*Assistant Examiner*—Andrew W Sutton
(74) *Attorney, Agent, or Firm*—David A. Guerra

(57) ABSTRACT

The invention relates to a universal removal device enabling a footware item having a very short or very long upper from one or two moulds (28) side by side and at different heights with a normal inclination of the foot and a normal heel. The inventive device consists of two vertical belts (1) and (2) which pinch the foot of the item in order to extract it while remaining rotationally fixed with displacement according to the axis A-A' of the foot, in order to subsequently tilt the belt (38) with the aid of fingers (58) and (59). The rotation of the belts (1), (2), (38) and (66) and the simultaneous elevation of the fingers (58) and (59) at the same speed completes the removal of articles of any length without folds or tensing occurring. The inventive removal device is used, in particular, on machines which are used to form socks and tights.

18 Claims, 6 Drawing Sheets

DEVICE ENABLING A FOOTWARE ITEM TO BE REMOVED FROM A MOULD

CROSS-REFERENCE TO RELATED APPLICATIONS

This application is an U.S. national phase application under 35 U.S.C. §371 based upon co-pending International Application No. PCT/FR02/00507 filed on Feb. 2, 2002. Additionally, this U.S. national phase application claims the benefit of priority of co-pending International Application No. PCT/FR02/00507 filed on Feb. 2, 2002. The entire disclosures of the prior applications are incorporated herein by reference. The international application was published on Aug. 21, 2003 under Publication No. WO 03/069040 A1.

The invention relates to a universal device enabling a footwear item to be removed from a solid metal mould or a tubular mould or two moulds arranged side by side, the items being socks or pairs of socks having a short or very long upper, tight legs or assembled tights, or ladies' stockings, knit with any kinds of fibres. All these articles being on moulds at different heights with a normal inclination of the foot forming an angle of about 40° with the vertical plane and with a normal heel.

The treatment of footwear items, socks, stockings and tights is made on metal moulds so as to be able to combine various treatments with application of humidity and heat. Generally, the items fitted manually are, after treatment, automatically removed from the moulds with a mechanical removal device. There are presently two types of removal devices in use in the textile industry.

The first one is constituted by two clamps covered with rubber which grip the item on top of the mould and extract it by strongly pulling at it so as to remove it from the mould. This device is presently used on 95% of the sock boarding machines existing on the market. It is then necessary to pivot the article, which is held at its top by the clamps and hangs vertically from the top to the bottom, from the vertical position to the horizontal position, by means of a racket driven by a very fast circular motion.

This device does not permit a fair appearance of the articles and completely lacks of accuracy and repetition potential. It is completely inefficient for long items and also for fine items, such as stockings or ladies' tights. In addition, the very fast circular motion of the racket damages the pivoting mechanism.

The second type of removal device is substantially composed of two belts, which after pinching the article on the mould, begin to rotate so as to remove the article thereof. It has the advantage of being able to quickly extract very long items, and with an adequate arrangement of the belts, to have the item smoothly pass from the vertical to the horizontal position. It is generally used to remove long items.

On the contrary, the great disadvantage thereof is that it can only remove items from moulds with a very small inclination of the foot in relation to the vertical plane and with a very attenuated heel. This is, as a matter of fact, contrary to nature as, when used, the articles are put on human feet that have a 90° angle with the vertical plane, which is in addition detrimental to the user's comfort. On the other side, this lack of inclination does not allow, when packaging the items, to properly fold the foot of the article onto the upper thereof.

Both of these types of removal devices are used on boarding machines, either specialized in the treatment of socks or in the treatment of tights with different heights of moulds and also very various inclinations of the feet.

None of both of these types can be used on the same machine that would, on the contrary, have the advantage of permitting to treat very various items and to remove them all from moulds having a normal inclination of the foot.

The aim of the present invention is to eliminate all these disadvantages by enabling to remove with the same device any types of footwear items from socks with a short upper to very long tights, going through children' tights, men' socks and ladies' stockings made out of any kinds of materials, with a normal inclination of the foot, that is to say to be universal.

The present invention is characterized in that the foot of the item is pinched between two very short conveyor belts arranged vertically and that subsequently this assembly is driven by a translation motion in the same direction as the axis of the foot of the mould so as to extract only the foot of the article, whereby the two conveyor belts remain rotationally fixed. In this operation they are aided by a pair of fingers located on either side of the mould, which, in an horizontal rotating motion, grip the lower portion of the article and are subsequently actuated by an ascending motion at the same speed as the displacement speed of the assembly of the two conveyor belts. At the end of the travel, the two conveyor belts tangentially stop at a belt located horizontally while the two fingers elevating the item simultaneously stop.

It is characterized in that, in a second time, the complete extraction of the item is achieved by putting in rotation the various conveyor belts adequately arranged so that the article completes its travel on a conveyor belt having a 45° inclination, still aided for this purpose by the two fingers elevating the article, which accompany it at the same speed as the linear speed of the conveyor belts so that the article which has been so removed is not tensed or creased during the last stripping phase by the various belts.

It is also characterized by the possibility to adjust the height of article collection belts horizontally and vertically and to incline them so as to fit each item, which enables to obtain a good appearance of the article and to strip moulds of different heights and to bring the upper of the item in line with the toe of the mould.

It is also characterized in that the stripping head can be positioned at different heights in relation to the size of the moulds and that it enables, with the same device, to remove small or long items having small or very long uppers.

One of the characteristics of this invention is that it also enables to superpose items at the outlet of the inclined belt, either by pairs for subsequent packaging or by stacks of a plurality of items for storage until the next process.

The explanations and FIGS. indicated hereinafter as an example allowing to understand how the invention can be achieved.

Figure 1:
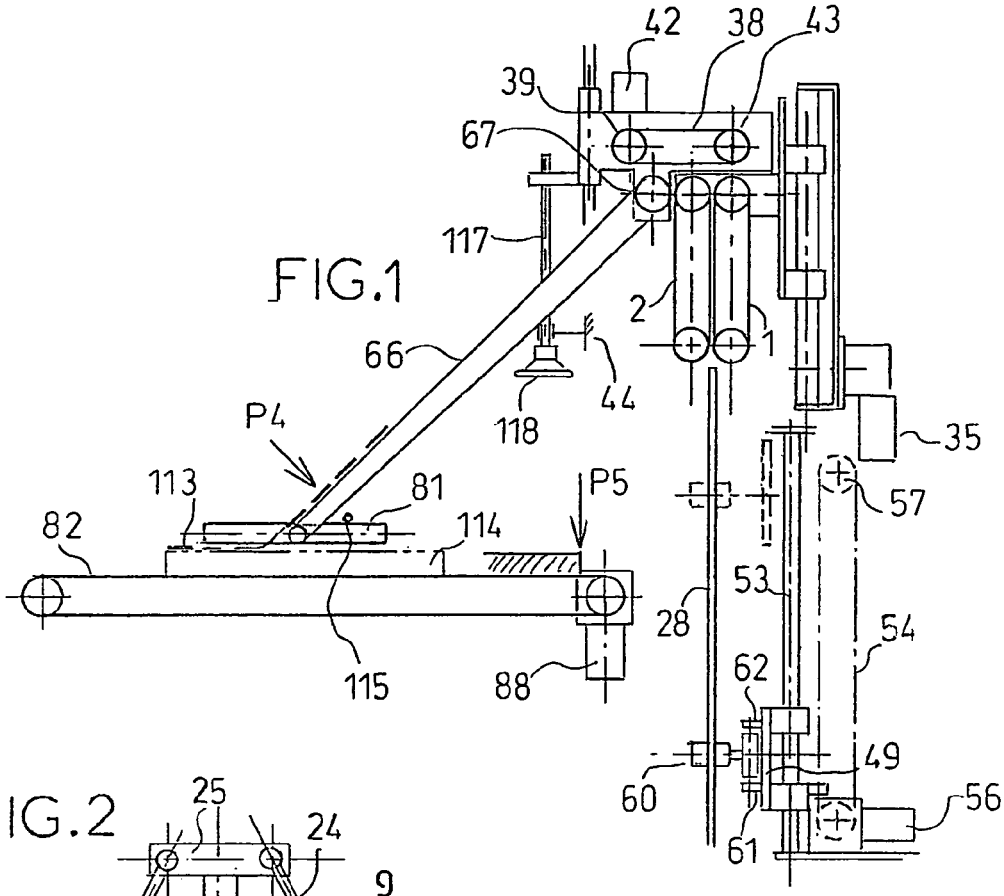
FIG. 1 is a side view of the removal device unit.
Figure 2:
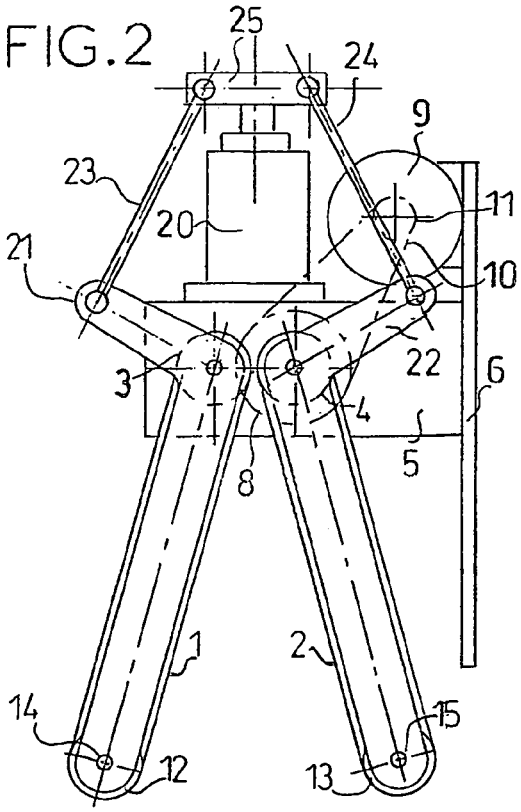
FIG. 2 shows the pinching belts with the drive mechanism.
Figure 3:
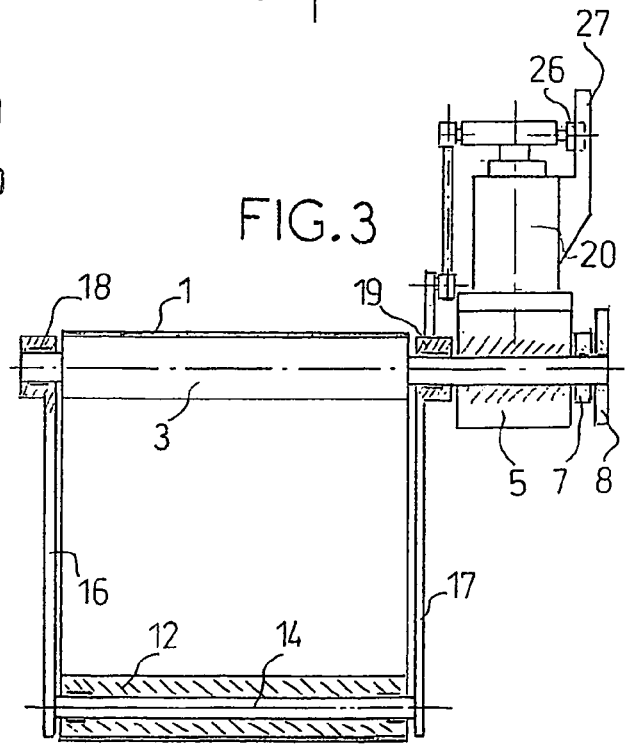
FIG. 3 is a cut view of the pinching belts

As shown on FIGS. 1, 2, 3 board 1/6, the universal removal device is constituted, among others, by two conveyor belts (1) and (2), driven by the 2 driving rollers (3) and (4) rotating within the support (5) which is integral with the slider (6), at the end of the driving rollers are keyed two gears (7), which permit the two rollers to rotate in the opposite direction.

On one of two pins is integrally affixed a toothed pulley (8) which is driven by a motor (9) by means of a synchronous belt (10) and a small toothed pulley (11), fixed on the pin of motor (9). The two belts (1) and (2) are tensed by two idle rollers (12) and (13) rotating respectively about pins (14) and (15).

The structure of each belt is constituted, for belt (1), by the left arm (16), the pin (14) and the right arm (17), the whole assembly pivots about the driving pin of roller (3) by means of two bearings (18) and (19).

The structure of belt (2) is constituted in the same way.

The pivoting drive of the two belts (1) and (2) is effected by jack (20) which actuates the two levers (21) and (22) by means of the two small connecting rods (23) and (24), fixed on part (25) integral with jack pin (20).

The symmetrical displacement of the two belts in relation to the vertical axis is made by roller (26), which slides into the vertically arranged groove (27).

The assembly of the belts (1) and (2) of the drive mechanism, and of the pinching device, described above, is secured onto a slider (6), FIG. 4 (board 2/6).

The slider (6) moves according an axis parallel to the axis A-A' of the foot of the mould (28) with an angle of about 40° in relation with the vertical plane. It is guided in its movement by three bearings (29) sliding along the two pins (30) and (31).

The translation displacement of the whole assembly is made by a mechanism constituted by a synchronous belt (32), an idle pulley (33), and a driving pulley (34), keyed on the outlet shaft of a gear motor (35), the whole being fixed on a frame (not shown) by means of brackets (36) and (37).

Figure 6:
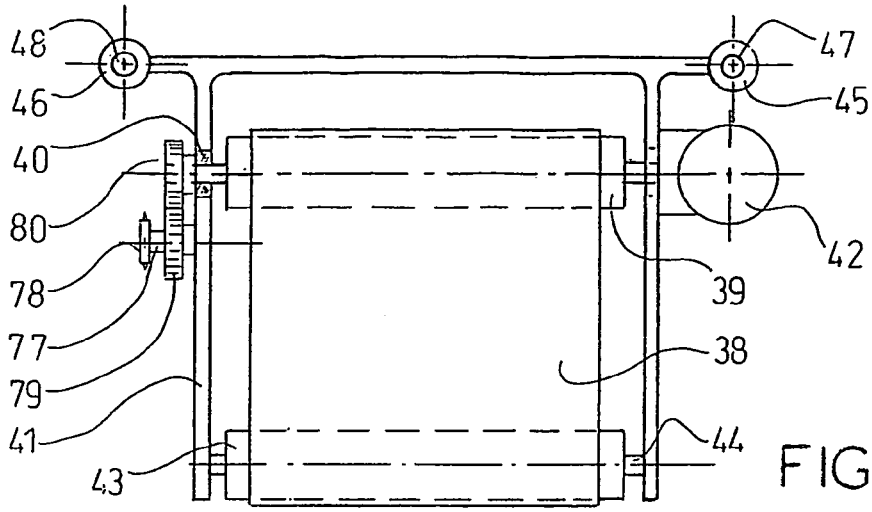
FIG. 6 is a top view of the upper belts

The upper part of the universal removal device is constituted by a conveyor belt (38) (FIGS. 1 and 6, respectively boards 1/6 and 3/6) driven by a roller (39), such roller rotating at one end within a bearing (40), which is integral with the framework (41), and fixed at the other end in a gear motor with a hollow shaft (42), integral with the framework (41).

The tension of the belt (38) is achieved by an idle roller (43) rotating about a pin (44) which is fixed on the framework (41).

The height of this framework assembly is adjustable with screw (117) and wheel (118), axially immobilized by bearing (44) integral with the frame (not shown).

The guiding of the vertical displacement of the framework (41) is achieved by the two sliders (45) and (46) and the pins (47) and (48) integral with the frame (not shown).

Figure 5:
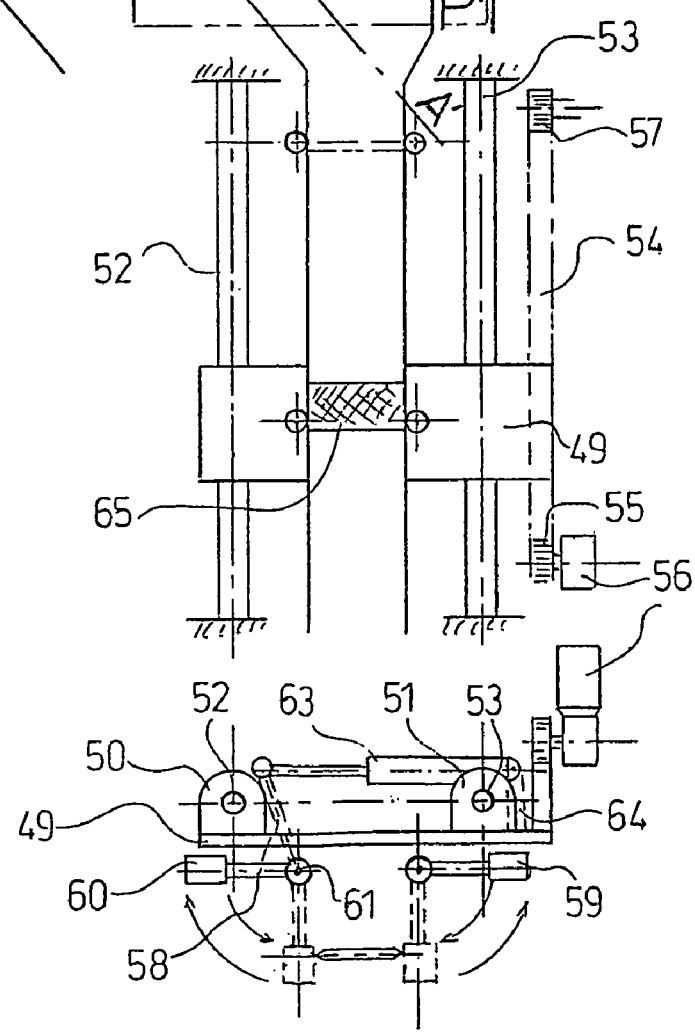
FIG. 5 is a top view of the fingers elevating the articles

The lower part of the removal device, as shown in FIGS. 1 and 5 (respectively boards 1/6 and 2/6) is constituted by a plate (49), guided by bearings (50) and (51), which moves vertically on pins (52) and (53) fixed on the frame (not shown), by means of a synchronous belt (54) secured on the plate (49), such plate being driven, at its lower part, by a pulley (55) keyed on a gear motor (56) integral with the frame (not shown), the upper part of the belt being returned by an idle pulley (57) secured on the frame (not shown).

On the plate (49) two levers (58) and (59) are fixed. Only lever (58) will be described in detail, lever (59) being strictly identical. Lever (58) is provided, at its end, with a part made of rubber (60). It articulates about a pin (61) secured on the plate by two brackets (62).

The lever, which can move by 90° on the horizontal plane, is actuated by a jack (63), articulated between the end of the lever (58) and a bracket (64), integral with the plate (49).

Figure 7:
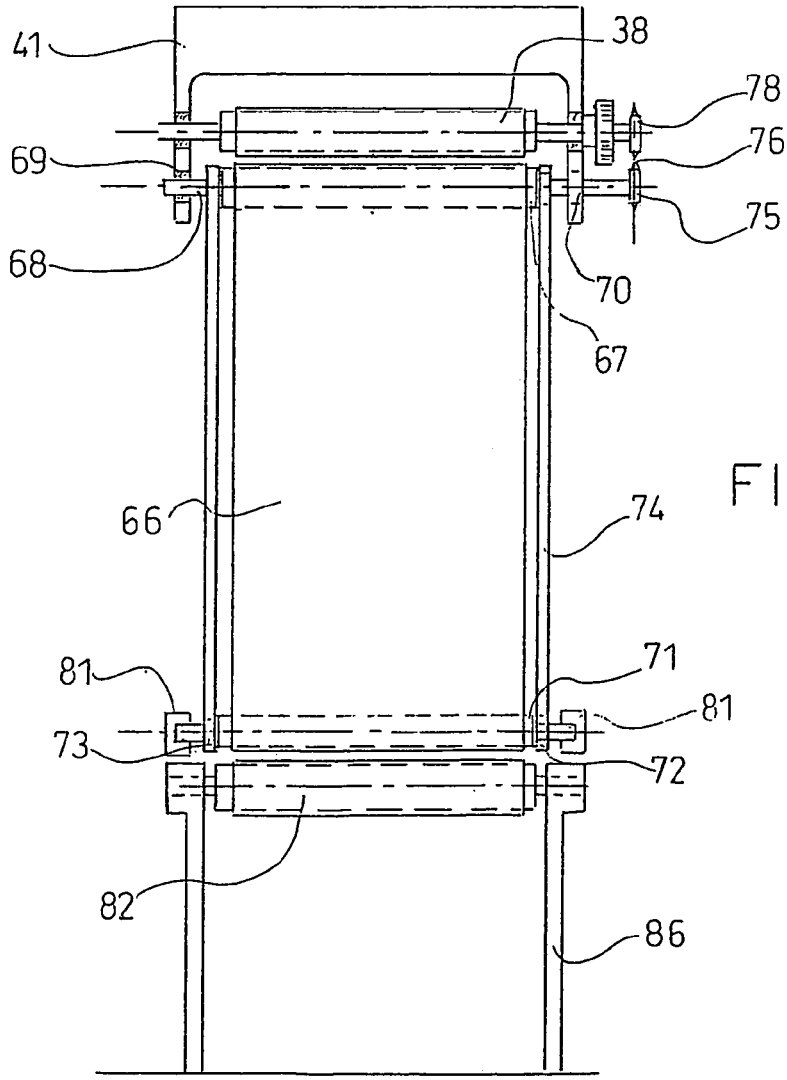
FIG. 7 is a front view of the descending belt of the articles.

The drive roller of the conveyor belt (66) (FIG. 1—board 1/6—and FIG. 7—board 3/6) inclined by about 50° in relation to the vertical plane, is driven in its upper part by a driving roller (67), whose pin (68) integral with it, is articulated on the framework (41) by means of two bearings (69) and (70) (FIG. 7). At its lower part, the conveyor belt (66) is tensed by means of a small idle roller (71), rotating within the two bearings (72) and (73), integral with the framework (74), which connects the two rollers (67) and (71).

The driving of the upper roller (67) which drives the conveyor belt (66), is made by a chain sprocket (75), keyed on pin (68) of roller (67), sprocket (75) is connected to sprocket (78) by a chain (76), sprocket (78) being integral with gear (79), both rotating about an idle pin (77), the gear (79) engages itself with gear (80) keyed on the pin of roller (39), which permits the roller (67) to rotate in a direction opposite to the direction of the roller (39).

Both ends of the idle roller (71) fit into the two sliders (81), arranged horizontally. These two sliders can move vertically, parallel to the belt (82), by means of a parallelogram (84), actuated by a jack (85) secured at one of its ends onto the frame (86), FIG. 6, board 4/6.

The vertical displacement of the two sliders (81) can, in another form of embodiment, be achieved by means of a wheel connecting rod system (16) allowing to adjust the height of the belt (66) in relation to the number of items detected in height by means of a photoelectric cell (115) (FIG. 1).

A conveyor belt (82) (FIG. 8 board 4/6), arranged horizontally under belt (66), is tensed between a driving roller (87), driven by a gear motor (88), and a tensing idle roller (89), the assembly being secured onto a framework (86).

Figure 10:
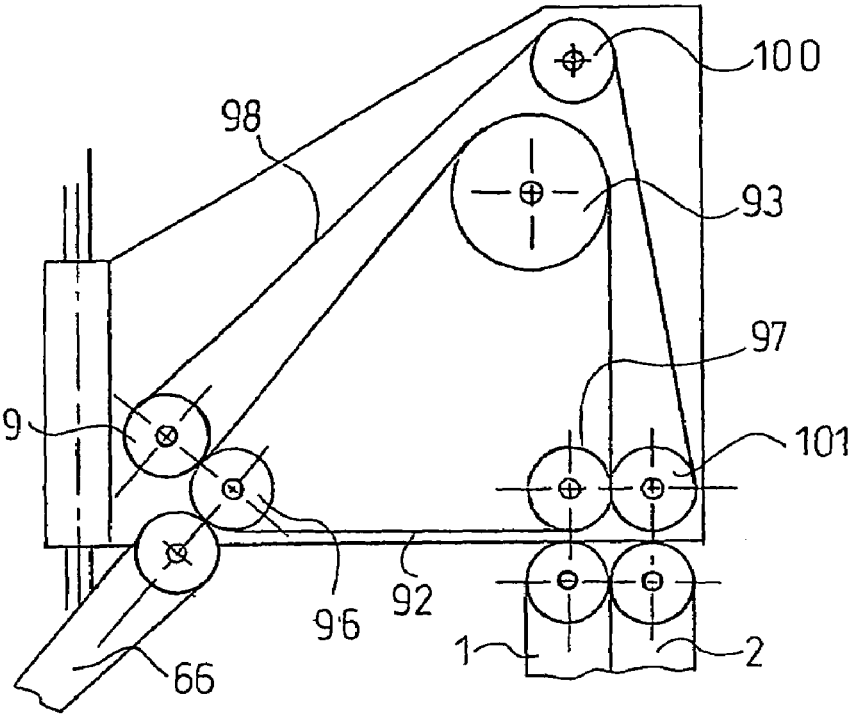
FIG. 10 is a side view of a different embodiment of the upper belt.
Figure 11:
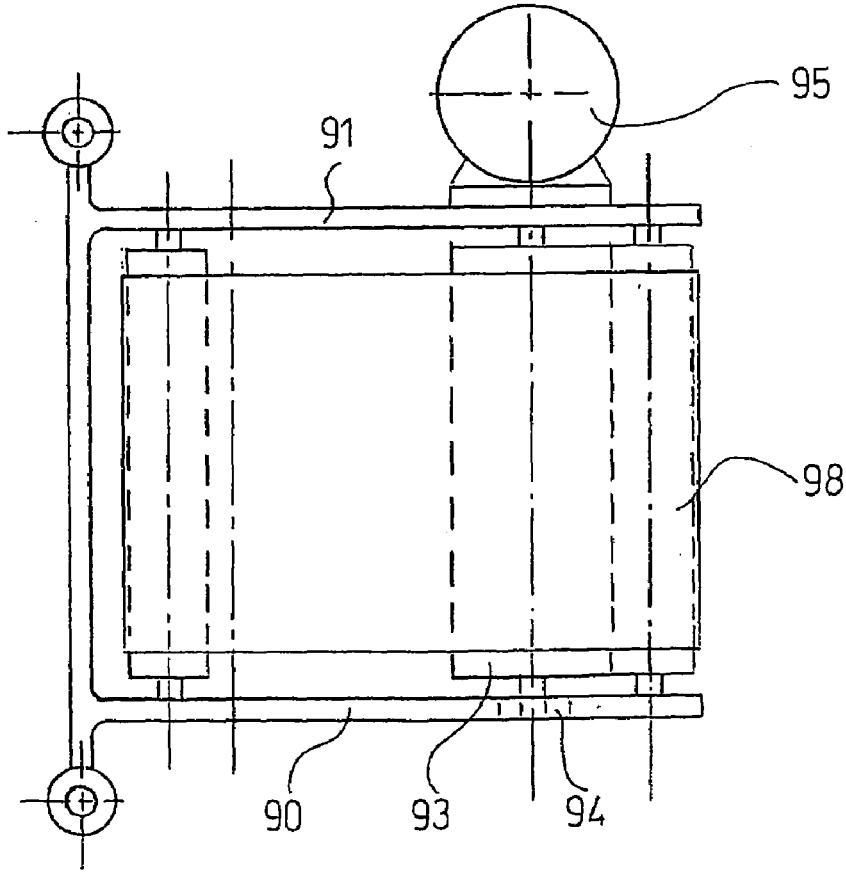
FIG. 11 is a top view of this belt.

In another form of embodiment, the upper part of the universal removal device, shown in FIGS. 10 and 11 (board 5/6), is constituted by two sides (90) and (91), a conveyor belt (92), driven by a driving roller (93) which, at one of its ends rotates within a bearing (94) and, at the other end, is driven by a gear motor (95) fixed on side (91). In addition, conveyor belt (92) is tensed between two idle rollers (96) and (97). A second conveyor belt (98) comes to superpose the first one and winds around idle rollers (99), (100) and (101), the two sides (90) and (91) are connected to a framework, as described in FIG. (11), permitting to adjust the height thereof.

Figure 12:
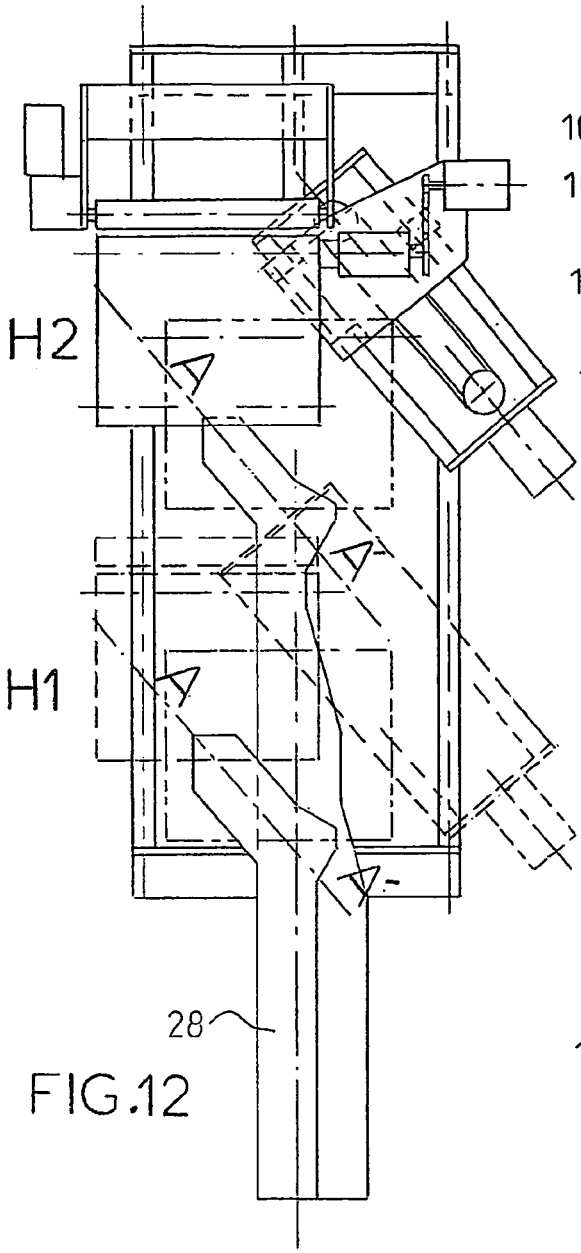
FIG. 12 is a front view.
Figure 13:
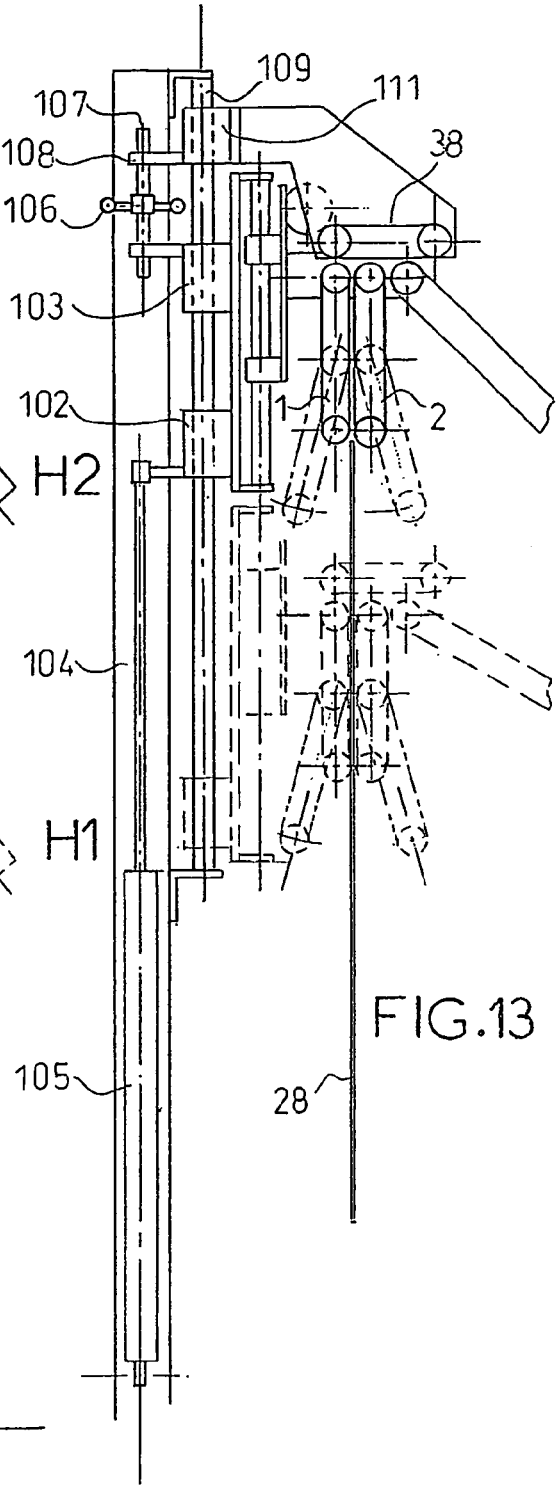
FIG. 13 is a side view and FIG. 14 is a top view showing a different form of embodiment of the removal device, allowing to position the stripping head at different heights so as to remove items from moulds which are not of the same height.
Figure 14:
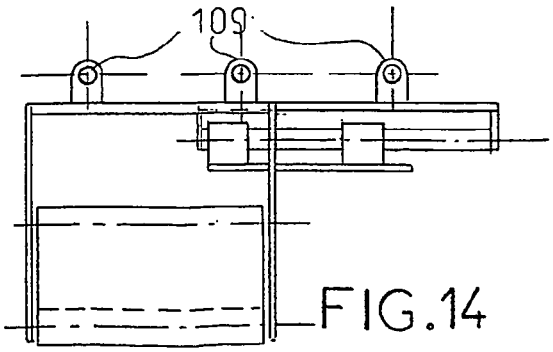

Another form of embodiment is shown in FIGS. 12, 13, 14 (board 6/6).

Figure 4:
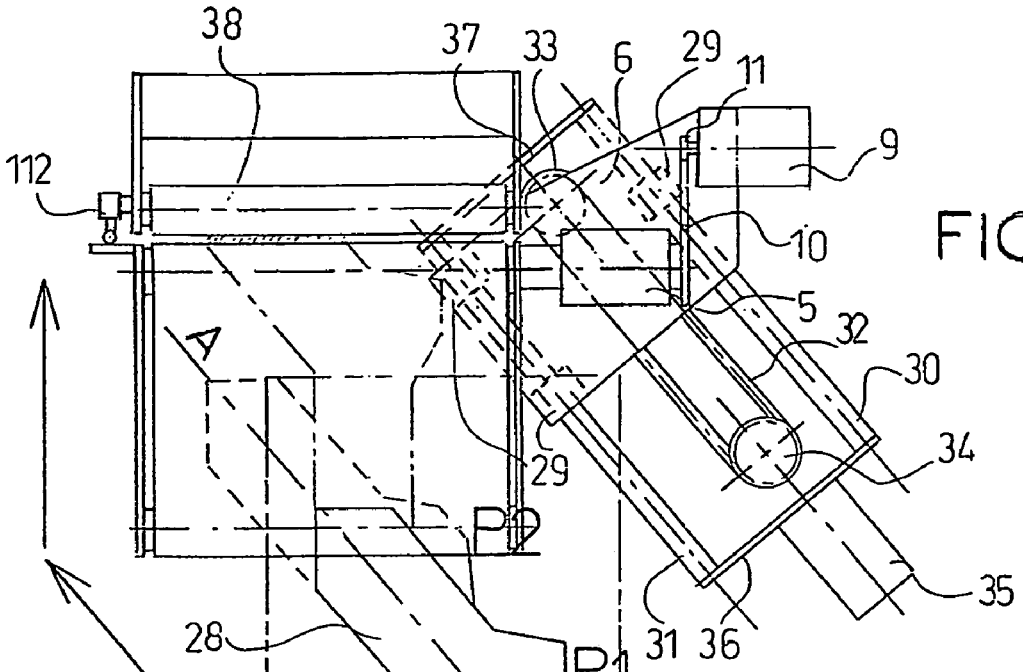
FIG. 4 is a front view of the stripping head and its displacement mechanism and the elevation fingers

The slider (6) FIG. 4, the conveyor belts (1) and (2), the pivoting drive FIG. 2, and the mechanism for the displacement of the slider FIG. 4, shown on the boards 1/6, 2/6 will be called in the description hereinafter: stripping belt, which has previously been the subject matter of a detailed description.

The stripping belt unit can take up several positions, and particularly two different positions, (H1) and (H2), as shown in FIG. 12 (board 6/6).

For this purpose, the assembly can slide by means of bearings (102) and (103), along posts (109), arranged vertically which are integral with a framework (104). The position (H1) or (H2) is maintained by a pneumatic jack (105) driven either manually or automatically.

The position of the upper part of the removal device previously described and shown on board 6/6 FIG. 13 can be adjusted in relation to the stripping belt unit by means of a wheel (106) which, while rotating, actuates screw (107) which is right-hand threaded at one of its ends, the other end being left-hand threaded, leading to the fact that the slider gets closer or away in relation to slider (108). The upper part of the removal device can move vertically by means of bearings (102) on posts (109).

The universal removal device as described above operates as follows:

When a mould (28), or a pair moulds arranged side by side, fitted with one or two items appear under the removal device, the two pinching belts (1) and (2) descend according to axis A-A', guided for this purpose by bearings (29) and pins (30) and (31). In position "P1" (FIG. 4) the two belts (1) and (2) pinch the foot of the article under the action of jack (20), part (25) and the two small connecting rods (23) and (24) which act On levers (21) and (22) by operating them.

They are subsequently actuated by an ascending motion in direction of axis A-A', driven for this purpose by gear motor (35) and the whole device described previously and subsequently tangent the belt (38) at the end of the travel.

Simultaneously, fingers (58) and (59) come in contact with the lower portion (65) of the article fitted on the mould (28) under the action of jack (63).

They are subsequently actuated by a movement from the bottom to the top, at the same linear speed as belts (1) and (2), thanks to gear motor (56). At the end of the travel, the two belts (1) and (2), position tangentially in relation to the horizontal belt (38) thanks to sensor (112). At the same time, fingers (58) and (59) are stopped in their motion.

Both these operations allow to remove the foot of the item from the mould, without however pulling at it, thanks to the action of the two fingers (58) and (59). Consequently, the foot of the item finds itself in position P2 without being out of shape.

The adjustment of the height of the belt (38), which embodies the invention: its framework (41) on which sensor (112) is fixed, allows, as shown in FIG. 4 (board 2/6), with the stop of the ascending travel of belts (1) and (2), to adjust the alignment of the article upper being stripped, in position P3, in continuation of the foot of the mould.

The next stage consists in simultaneously putting belts (1), (2), (38) and (66) in rotation by means of the various motors and gear motors (9) and (42), and to resume the ascending motion of the two fingers (58) and (59).

So as to complete the removing of the article without folds or tensing occurring so as to bring it in adequate position on belt (66), on stop in position P4.

The belt (82) moves forwards upon each rotation of belt (66), by means of gear motor (88), which allows to lay down an item (113) FIG. 1 onto the stack of items (114), which moves forwards at the same speed.

After each laying down of articles onto the stack of items (114), the belt (82) moves forwards in the opposite direction, which allows the stack of items to return to position P5.

Figure 8:
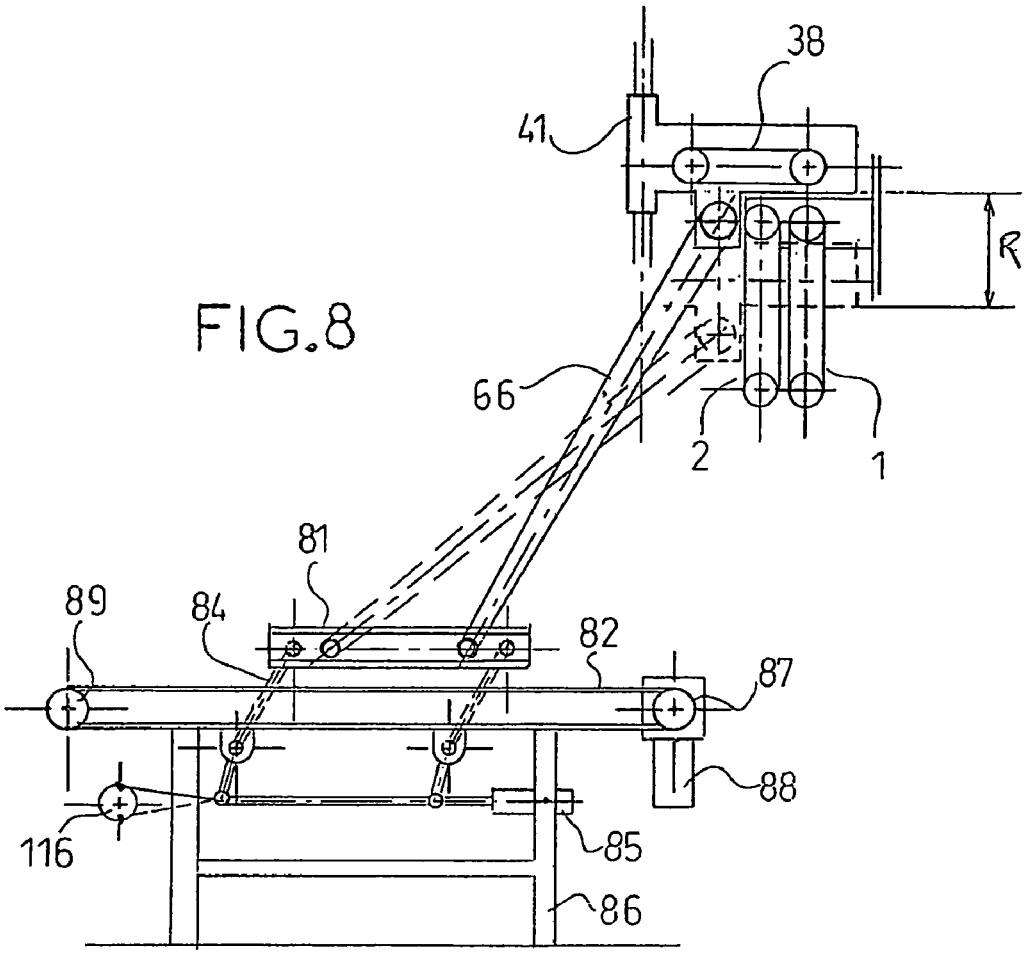
FIG. 8 is a side view of the descending belt with the extreme adjustment positions and of the horizontal belt and of the removal mechanism of the lower portion of the belt.
Figure 9:
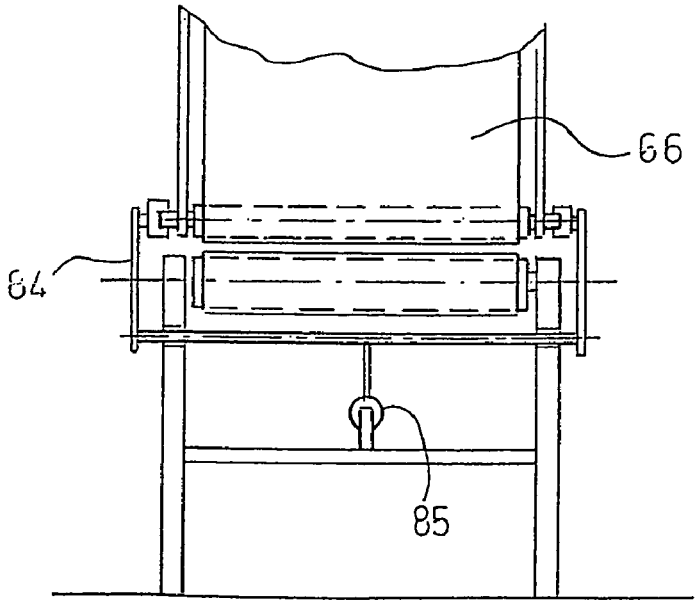
FIG. 9 is a front view of the horizontal belt with the elevation mechanism of the descending belt.

Prior to the return of the stack of items (114), the end of the belt (66) is released towards the top by means of the mechanism FIG. 8 and FIG. 9 and of jack (85).

Prior to each new laying down of an article onto the stack of thereof, belt (66), thanks to its mechanism (81), (84), (85) is brought to a convenient height in relation to the indication of cell (115), enabling a correct laying down of a new article onto the stack.

The stack of items can be constituted only by two articles forming a pair and can consequently be packaged straightaway on the horizontal belt (66). FIG. 8 shows that: in spite of the extreme positions taken up by upper belt (38) during adjustment R thereof, by reason of the fact that the upper roller (67) is integral with the framework (41) through bearings (69) and (70), the small lower roller (71) of belt (66) always remains parallel to the horizontal belt (82) thanks to the two sliders (81), articulated by means of parallelogram (84), positioned in height, either with a jack (85), or a connecting rod system (116).

The operation of the belts shown in FIGS. (10) and (11) is identical with the operation of upper belt (38), the embodiment is very different and can allow to strip items which are very difficult to remove from a mould.

In FIGS. 12, 13, 14 the universal removal device is used to remove items from moulds of different heights. The original positioning of the stripper head, in H1, is made by means of jack (105), which can be manually or automatically driven to come to position. H2.

These two positions allow, with the same device, to strip very small items or very long items.

Of course, the invention is not limited to the example of embodiment described above and represented, from which other forms of embodiments can be foreseen, without coming out of the framework of the invention.

The universal removal device is intended for use on boarding machines for socks of any sizes, with short or long uppers, or machines for boarding children or ladies' tights, leg by leg or assembled, knit with very fine yarn or very thick yarn.

The invention claimed is:

1. Universal removal device allowing to remove a footwear item from a metal mould, solid or tubular, or two moulds arranged side by side, the items being socks or pairs of socks with small or very long uppers, tight legs or assembled tights, or ladies' stockings, knit with any kinds of fibres, all these items being on moulds at different heights, with normal inclination of the foot, forming an angle of about 40° with the vertical plane and having a normal heel, comprising:

two pinching belts and fitted on a slider;

two stripping fingers; and a horizontal belt and a succession of belts to collect the article;

wherein order to remove a footwear item from a mould, the two belts, after having pinched the article in the upper portion thereof, while remaining rotationally fixed, move, guided by sliders in the same direction as axis A-A' of the foot of the mould so as to remove the foot, aided for this purpose by the two fingers which are in contact with a lower portion of the article and which elevate it at the same speed as the displacement of the two belts in an ascending motion, along the upper, in order to avoid any tensing or folds occurring on the article, and that subsequently, the complete removal of the article, whatever the length thereof, is achieved by putting in simultaneous rotation the two belts, the horizontal belt, and the succession of belts, still aided for this purpose by the two fingers moving at the same linear speed as the two belts;

wherein the horizontal belt is adjustable in height, which allows to stop the two belts, tangentially to the horizontal belt, at different positions, by means of a screw and a wheel, a framework moving vertically on pins, so as to allow, on final stripping, to align the upper of the article with the foot of the mould.

2. The universal removal device according to claim 1, wherein the pinching drive of the two belts is achieved by means of a jack, two levers and a connecting rod system, vertically centered by a roller, moving within a groove which is vertical.

3. The universal removal device according to claim 2, wherein the two belts are rotationally driven in the opposite direction by two rollers rotating within a support integral with the slider, which have at their end an integral gear.

4. The universal removal device according to claim 3, wherein a framework associated with at least one of the two belts is articulated about a pin of at least one of the two rollers via bearings.

5. The universal removal device according to claim 1, wherein the two belts at the end of the ascending travel and tangent to the horizontal belt, so as to allow the article to naturally pass onto the descending belt, and are automatically positioned under the action of a sensor which acts on the drive of the a motor which is integral with a framework of the horizontal belt.

6. The universal removal device according to claim 1, wherein the horizontal belt comprising of a first belt driven by a roller, is tensed between two idle rollers, and a second belt which comes into superimposition with the first belt and winds around idle rollers.

7. The universal removal device according to claim 1, wherein at least one of the succession of belts is articulated by means of an upper pin on a framework via bearings the at least one of the succession of belts integrally moves during adjustment of the horizontal belt.

8. The universal removal device according to claim 7, wherein a stripping belt assembly takes up at least two positions by means of a pneumatic jack and with the aid of bearings moving along posts, so as to permit to strip moulds of different heights.

9. The universal removal device according to claim 8, wherein a pin of a lower roller of the descending belt moves, during adjustment of the height of the horizontal belt or the stripping assembly in the two positions, within two sliders arranged horizontally.

10. The universal removal device according to claim 9, wherein the horizontal belt with its framework, can be adjusted in distance in relation to the framework of the stripping belt by means of a screw having a right-hand thread and a left-hand thread and a wheel.

11. The universal removal device according to claim 9, wherein the two sliders, arranged horizontally can move vertically and parallel to at least one of the succession of belts by means of a parallelogram actuated by a jack.

12. The universal removal device according to claim 9, wherein a parallelogram being actuated by a connecting rod system thus allowing to position the lower roller of at least one of the succession of belts in relation to the height of a stack of articles detected by means of a photoelectric cell.

13. The universal removal device according to claim 9 comprising a conveyor belt inclined by about 50° having at its lower part an idle roller fitted in the two horizontal sliders which can move vertically by means of a parallelogram and a horizontal conveyor belt located under at least one of the succession of belts, wherein the horizontal conveyor belt advances upon each rotation of the at least one of the succession of belts, which allows to lay down an article onto a stack of articles and wherein an end of the at least one of the succession of belts is released towards the top so that the horizontal conveyor belt advances in the opposite direction and thus allows the return of the stack of articles.

14. A universal article removal system for removing a footwear item from a mould, the universal footwear removal system comprising:

two pinching belts and fitted on a slider;

two stripping fingers;

a horizontal belt; and at least two belts in succession to collect the article;

wherein order to remove a footwear item from a mould, the two pinching belts, after having pinched the article in the upper portion thereof, while remaining rotationally fixed, move, guided by sliders in the same direction as axis A-A' of the foot of the mould so as to remove the foot, aided for this purpose by the two fingers which are in contact with a lower portion of the article and which elevate it at the same speed as the displacement of the two pinching belts in an ascending motion, along the upper, in order to avoid any tensing or folds occurring on the article, and that subsequently, the complete removal of the article, whatever the length thereof, is achieved by putting in simultaneous rotation the two pinching belts, the horizontal belt, and the at least two succession belts, still aided for this purpose by the two fingers moving at the same linear speed as the two pinching belts;

wherein the two pinching belts at the end of the ascending travel and tangent to the horizontal belt, so as to allow the article to naturally pass onto a first of the at least two succession belts being the descending belt, and are automatically positioned under the action of a sensor which acts on the drive of the a motor which is integral with a framework of the horizontal belt.

15. The universal removal device according to claim 14, wherein the pinching drive of the two pinching belts is achieved by means of a jack, two levers and a connecting rod system, vertically centered by a roller, moving within a groove which is vertical.

16. The universal removal device according to claim 15, wherein the two pinching belts are rotationally driven in the opposite direction by two rollers rotating within a support integral with the slider, which have at their end an integral gear.

17. The universal removal device according to claim 16 further comprising a framework associated with at least one of the two pinching belts is articulated about a pin of at least one of the two rollers via bearings.

18. The universal article removal system according to claim 14, wherein the horizontal belt is adjustable in height, which allows to stop the two belts, tangentially to the horizontal belt, at different positions, by means of a screw and a wheel, a framework moving vertically on pins, so as to allow, on final stripping, to align the upper of the article with the foot of the mould.

* * * * *